US006420859B1

(12) United States Patent
Tsai et al.

(10) Patent No.: US 6,420,859 B1
(45) Date of Patent: Jul. 16, 2002

(54) VOLTAGE SUPPLY CONTROLLER

(75) Inventors: Hui Fang Tsai, Hsinchu Hsien; Chin Shin Yeh, Taichung Hsien; Te Sun Wu, Hsinchu, all of (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 09/796,950

(22) Filed: Feb. 27, 2001

(51) Int. Cl.[7] ..... G05F 1/40
(52) U.S. Cl. ..... 323/284
(58) Field of Search ..... 323/282, 284, 323/285, 273, 274, 275, 351

(56) References Cited

U.S. PATENT DOCUMENTS 5,627,460 A * 5/1997 Bazinet et al. ..... 323/288
6,011,721 A * 1/2000 Sunkavalli ..... 365/185.22
6,081,453 A * 6/2000 Iwahashi ..... 365/185.22
6,108,263 A * 8/2000 Bauser et al. ..... 365/230.01
6,188,206 B1 * 2/2001 Nguyen et al. ..... 323/222

* cited by examiner

*Primary Examiner*—Adolf Deneke Berhane
(74) *Attorney, Agent, or Firm*—Charles C. H. Wu; Wu & Cheung, LLP

(57) ABSTRACT

A voltage supply control apparatus, suitable for being applied to a low voltage operation device. The voltage supply control apparatus has a high threshold voltage transistor and a low threshold voltage transistor. When the low voltage operation device is not working, the low threshold voltage transistor is cut off, and the voltage drop of a high voltage received from the power source terminal of the low voltage operation device is controlled by the high threshold voltage transistor. In contrast, when the low voltage operation device is working, the operation enable signal output thereby conducts the low threshold voltage transistor to control the voltage drop of the high voltage received from the power source terminal, so that a high potential is obtained.

11 Claims, 4 Drawing Sheets

VOLTAGE SUPPLY CONTROLLER

BACKGROUND OF THE INVENTION

1. Field of the Invention

The invention relates in general to a voltage supply control apparatus. More particularly, the invention relates to a voltage supply control apparatus that provides a control of the magnitude of the supplied voltage while a low voltage operation device is or is not operated.

2. Description of the Related Art

To apply 3V to a device, to reduce the voltage Vcc to a required voltage, the dual gate oxide process is often employed, since the peripheral pad and I/O interface can be formed using the design of a 3V thick gate with a 3 micron standard. For other circuits, including the core cell and peripheral circuit, more advanced techniques, such as 0.18/0.15/0.13 micron, are used to obtain a voltage drop for Vcc. The die size can also be reduced to effectively decrease the total amount of die for each wafer, and thus, to cut cost and to strengthen compatibility in the market.

FIG. 1 shows a conventional voltage supply controller. A transistor 10 comprising a gate is coupled to the voltage Vcc as a voltage drop. By adjusting the threshold voltage of this device (that is, transistor 10), or connecting several devices (such as transistors 10, 12), the voltage to connect to the voltage receiving terminal of the device 14 is determined.

The above transistors 10, 12 can be other types of transistors, for example, a combination with a high threshold voltage Vtnh, a normal threshold voltage Vtn and a low threshold voltage Vtn1. Actually, as shown in the I-V characteristic curve of a transistor in FIG. 2, when the current I of the low voltage operation device is small (that is, in standby mode), the voltage VCCI at the voltage source receiving terminal of the low voltage operation device is higher. When the current I is large (that is, in the operation mode), the voltage VCCI at the voltage source receiving terminal of the low voltage operation device is lower.

The I-V characteristic curve is opposite to certain requirements. For ultra low voltage source devices, in standby mode, the voltage VCCI at the voltage source receiving terminal of a low voltage operation device 14 is higher, and so the internal standby current Isb of the low voltage operation device 14 is too large. For example, for a typical 4M SRAM, the standby current Isb has to be smaller than 10 mA to ensure a standby status. In contrast, in normal operation mode, the voltage VCCI at the voltage source receiving terminal of the low voltage operation device 14 is low, resulting in the internal operation current Icc of the low voltage operation device 14 to be ranged within tens of mA. This causes the problems of slow address access time (TAA) and small Vcc.

SUMMARY OF THE INVENTION

The invention provides a voltage supply controller to control the voltage VCCI of the voltage source receiving terminal of a low voltage operation device to be lower in a standby mode and higher in an operation mode. The above problems of having an exceedingly large standby current Isb, a slow address access time and a small VCC can thus be resolved.

The voltage supply controller provided by the invention is suitable for use in a low operation voltage device, which comprises a voltage source receiving terminal. While operating the low voltage operation device, an operation enable signal is output.

The voltage supply controller comprises a high threshold voltage transistor and a low threshold voltage transistor. The high threshold voltage transistor comprises a gate and a first source/drain region coupled to a high voltage and a second source/drain region coupled to the voltage source receiving terminal. The low threshold voltage transistor comprises a first source/drain region coupled to the high voltage, a gate to receive the operation enable signal, and a second source/drain region coupled to the voltage source receiving terminal.

When the low voltage device is not operated (that is, in standby mode), the low threshold voltage transistor is cut off. The voltage drop of the high voltage received by the voltage source receiving terminal is controlled by the high threshold voltage transistor. Therefore, the received voltage can be maintained at a lower state. In contrast, when the low voltage operation device is operated, the operation enable signal conducts the low threshold voltage transistor to control the voltage drop of the received high voltage.

The above high and low threshold voltage transistors include dual gate oxide transistors. The supplied high voltage is ranged between 3V to 5V. The threshold voltage of the high threshold voltage transistor is set at about 1 .2V, and the threshold of the low threshold voltage transistor is set at about 0.6V.

The invention further provides another kind of voltage supply controller suitably used for a low voltage operation device with a voltage source receiving terminal. When the low voltage operation device is operated, an operation enable signal is output.

The voltage supply controller comprises a high threshold voltage transistor, a low threshold voltage transistor and at least a voltage drop transistor. The high threshold voltage transistor comprises a gate and a first source/drain region coupled to a high voltage. The low threshold voltage transistor comprises a first source/drain region coupled to the high voltage, and a gate to receive the operation enable signal. The voltage drop transistor comprises a first control terminal coupled to second source/drain regions of the low and high threshold voltage transistors, and a second control terminal coupled to the voltage source receiving terminal to provide a voltage drop function.

When the low voltage device is not operated (that is, in standby mode), the low threshold voltage transistor is cut off. The voltage drop of the high voltage received by the voltage source receiving terminal is controlled by the high threshold voltage transistor and the voltage drop transistor. Therefore, the voltage can be maintained at a lower state. In contrast, when the low voltage operation device is operated, the operation enable signal conducts the low threshold voltage transistor. Together with the voltage drop transistor, the voltage drop of the received high voltage is controlled.

One voltage drop transistor can be used, and the gate control terminal thereof is coupled to the first control terminal. The high threshold voltage transistor, the low threshold voltage transistor and the voltage drop transistor comprise dual gate oxide transistors. The high voltage is ranged from about 3V to about 5V.

Both the foregoing general description and the following detailed description are exemplary and explanatory only and are not restrictive of the invention, as claimed.

DESCRIPTION OF THE PREFERRED EMBODIMENTS

Figure 1:
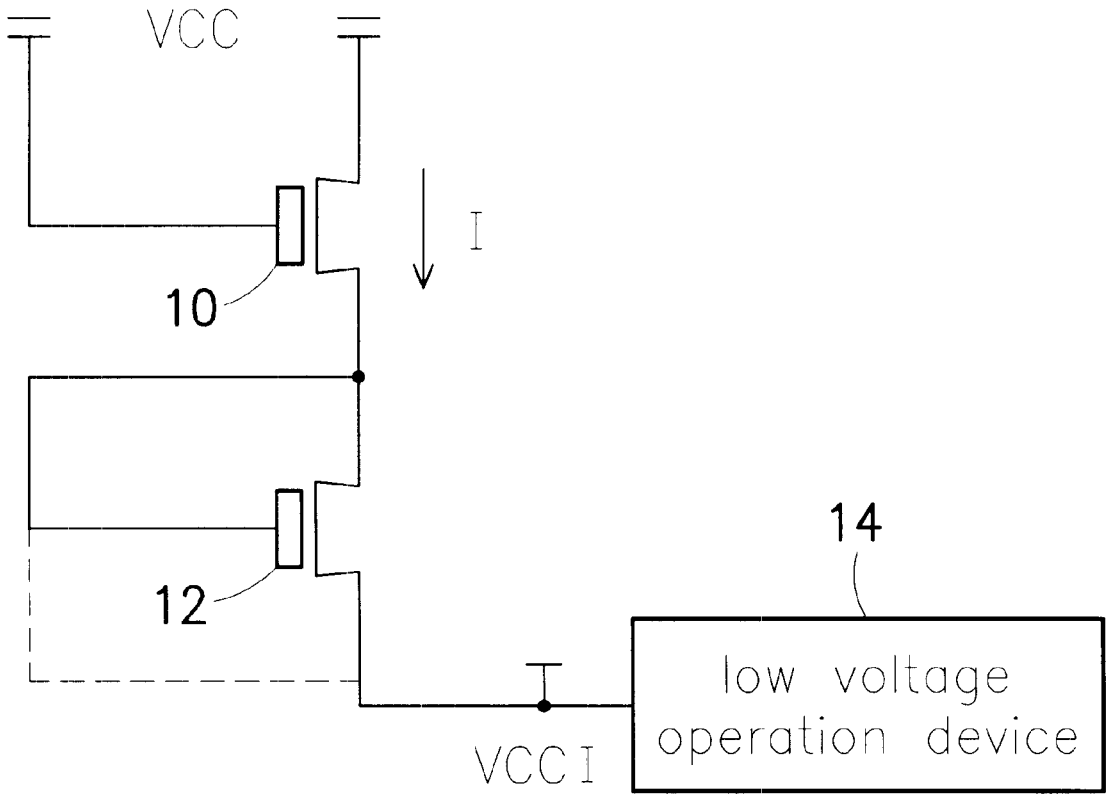
FIG. 1 (PRIOR ART)
FIG. 1 shows a conventional voltage supply controller.
Figure 2:
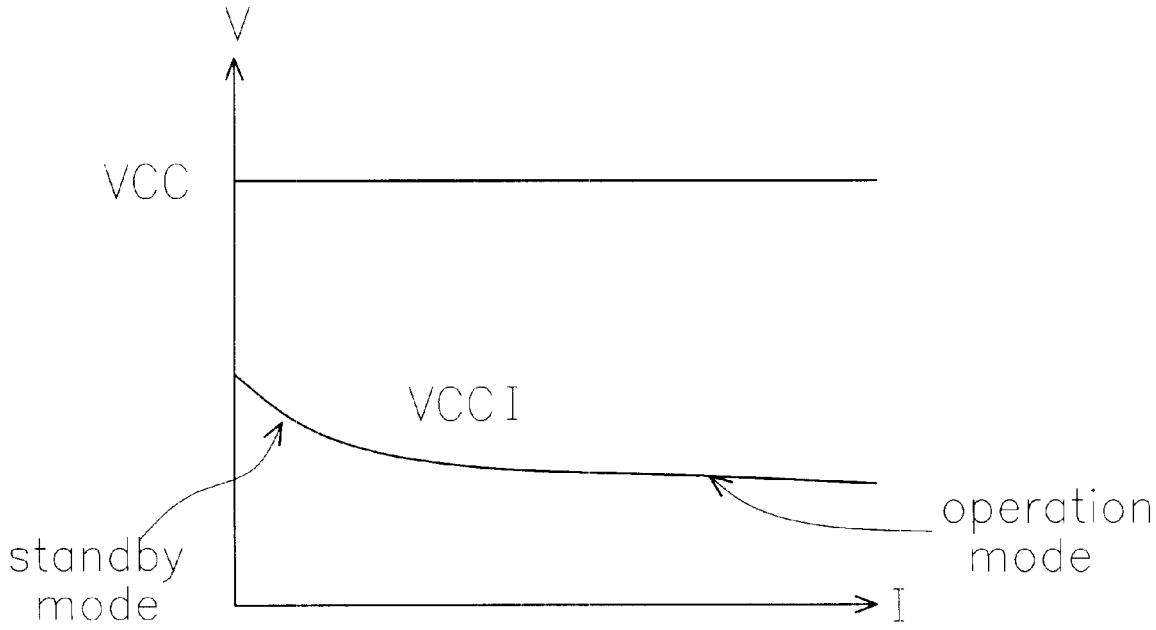
FIG. 2 (PRIOR ART)
FIG. 2 shows an I-V characteristic curve of a transistor.
Figure 3:
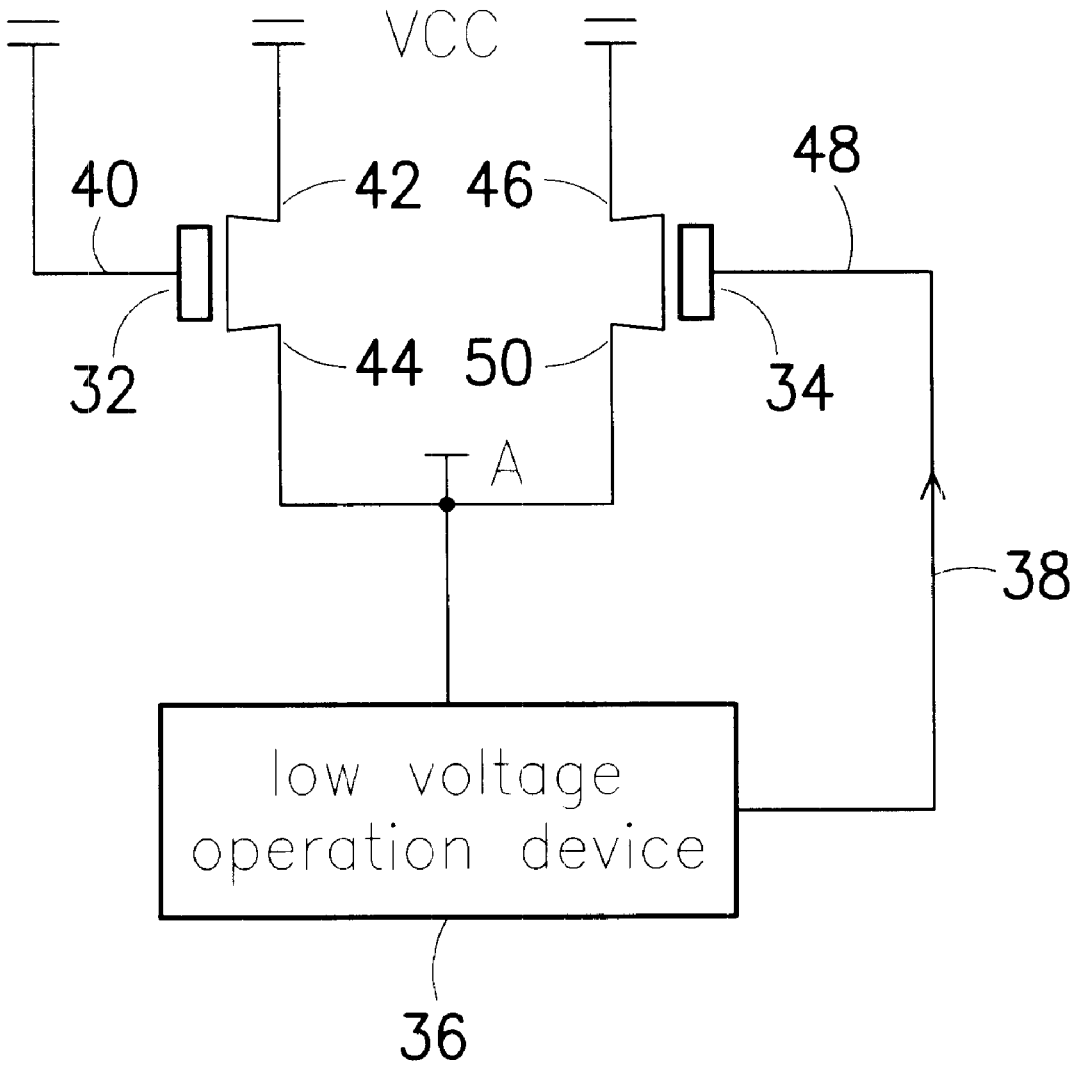
FIG. 3 shows a first embodiment of a voltage supply controller according to the invention.

Referring to FIG. 3, a first embodiment of a voltage supply controller according to the invention is shown.

In FIG. 3, the voltage supply controller 30 comprises a high threshold voltage transistor 32 and a low threshold voltage transistor 34. Both of the high and low threshold transistors 32 and 34 include dual gate oxide transistors coupled to a low voltage operation device 36. The low voltage operation device 36 comprises a voltage source receiving terminal A with a voltage VCCI. During the operation of the low voltage operation device 36, an operation enable signal 38 is output. The high threshold voltage transistor 32 comprises a gate 40 and a first source/drain region 42 coupled to a high voltage Vcc ranged between 3V to 5V, determined by the requirements of the low operation voltage device 36 and the threshold voltage of the high threshold voltage transistor 32. The high threshold voltage transistor 32 further comprises a second source/drain region 44 coupled to the voltage source receiving terminal A. The low threshold voltage transistor 34 comprises a first source/drain region 46 coupled to a high voltage VCC, a gate 48 coupled to an enable signal 38 and a second source/drain region 50 coupled to the voltage source receiving terminal A.

The effect of controlling the voltage VCCI at the voltage source receiving terminal of the low operation voltage device to be low under standby mode, and high under the operation mode is discussed as follows. When the low operation voltage device 36 is not operated (that is, in standby mode), the low operation voltage device 36 does not output the operation enable signal 38. The low threshold voltage transistor 34 is thus cut off. The voltage drop of the high voltage VCC received at the voltage source receiving terminal A is controlled by the high threshold voltage transistor 32. For example, if the threshold voltage is set at 1.2V and the input voltage is set at 3V, the voltage VCCI received at the voltage source receiving terminal A is 3V−1.2V=1.8V which is a lower voltage to resolve the problems caused by a large standby current Isb. In contrast, when the low operation voltage device 36 is operated, the operation enable signal is output to conduct the low threshold voltage transistor 34 to control the voltage drop of the high voltage VCC. If the threshold voltage is set at 0.6V, the voltage VCCI at the voltage receiving terminal under the operation mode is 3V−0.6V=2.4V. A higher voltage is thus obtained, and the operation current can be increased to shorten the address access time. The problem of having too small VCC is also resolved.

Figure 4:
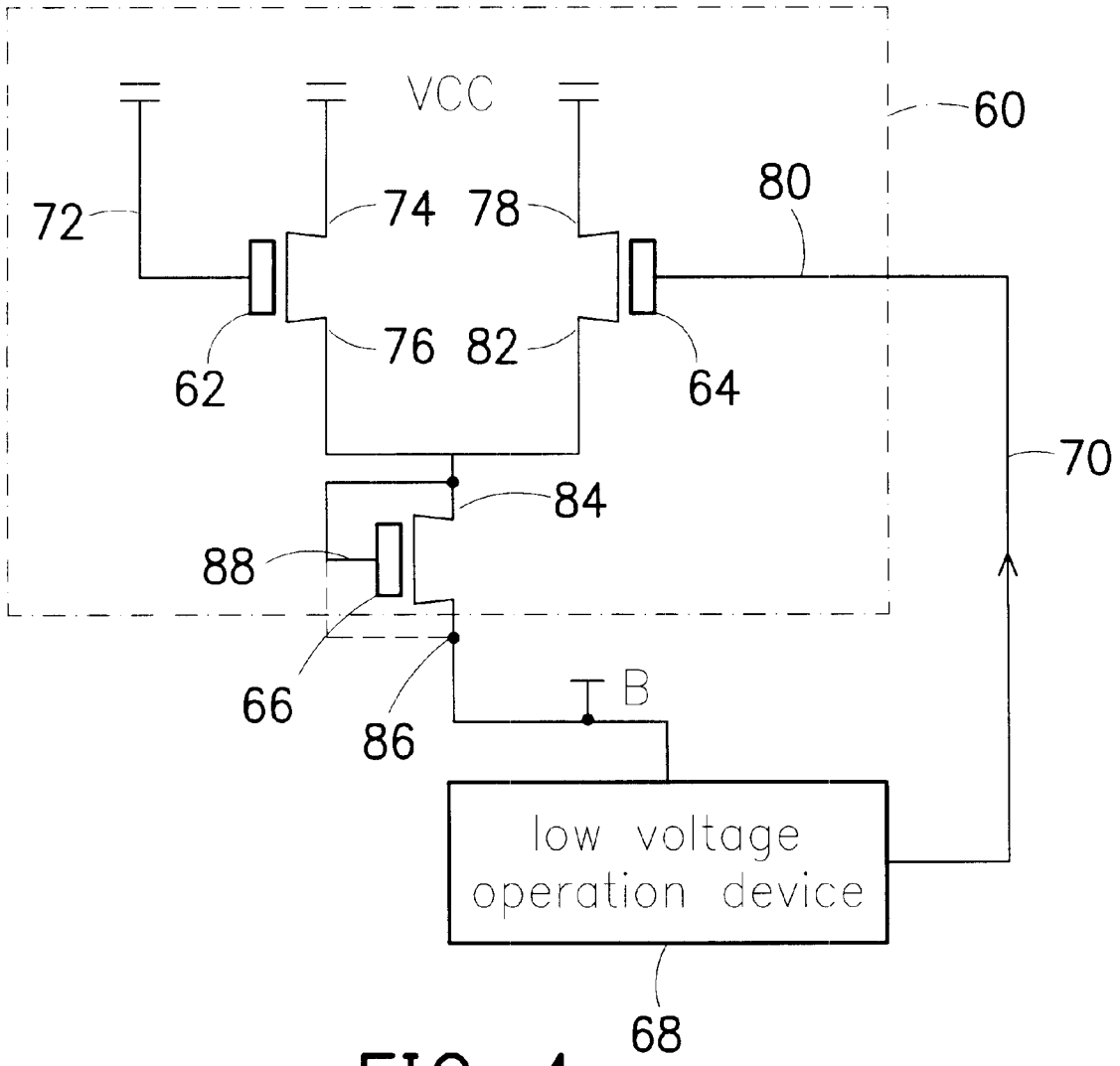
FIG. 4 shows a second embodiment of a voltage supply controller according to the invention.

FIG. 4 shows a second embodiment of a voltage supply controller according to the invention.

The voltage supply controller 60 comprises a high threshold voltage transistor 62, a low threshold voltage transistor 64 and at least one voltage drop transistor 66. The above transistors 62, 64 and 66 include dual gate oxide transistors coupled to a low operation voltage device 68 such as a cellular phone. The low voltage operation device 68 comprises a voltage source receiving terminal B with a voltage VCCI. While operating the low voltage operation device 68, an operation enable signal 70 is output.

The high threshold voltage transistor 62 comprises a gate 72 and a first source/drain region 74 coupled to a high voltage VCC ranged between 3V to 5V, determined by the requirements of the low operation voltage device 68 and the threshold voltage of the high threshold voltage transistor 62. The high threshold voltage transistor 62 further comprises a second source/drain region 76 coupled to a first control terminal 84 of the voltage drop transistor 66. The low threshold voltage transistor 64 comprises a first source/drain region 78 coupled to the high voltage VCC, a gate 80 coupled to the operation enable signal 70, and a second source/drain region 82 coupled to the first control terminal 84 of the voltage drop transistor 66. A second control terminal 86 of the voltage drop transistor 66 is coupled to the voltage source receiving terminal B to provide a voltage drop function. A gate voltage control terminal 88 of the voltage drop transistor 66 can be designed to connect to the first control terminal 84 (the solid line) or the second control terminal 88 (the dash line) according to the specific design of the voltage drop transistor 66. The operation is the same as the first embodiment. Only a voltage transistor 66 is added to provide a constant voltage drop.

According to the above, the voltage supply controller controls the voltage VCCI at the voltage source receiving terminal to be low under the standby mode and high under the operation mode. In addition, an excessively large standby current is prevented. The problems of a long address access time and a low high voltage are resolved.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A voltage supply controller, suitable for use for a low operation voltage device comprising a voltage source receiving terminal, the low operation voltage device outputting an operation enable signal during operation, the voltage supply controller comprising:

a first transistor, comprising a gate and a first source/drain region coupled to a high voltage, and a second source/drain region coupled to the voltage source receiving terminal, the first transistor having a first threshold voltage; and a second transistor, comprising a first source/drain region coupled to the high voltage, a gate to receive the operation enable signal, and a second source/drain region coupled to the voltage source receiving terminal, the second transistor having a second threshold voltage lower than the first threshold voltage; wherein when the low operation voltage device is not operated, the second transistor is cut off, and the voltage drop of the high voltage received at the voltage source receiving terminal is controlled by the first transistor, and when the low operation voltage device is operated, the operation enable signal conducts the second transistor to control the voltage drop of the high voltage.

2. The voltage supply controller according to claim 1, wherein the first transistor includes a dual gate oxide transistor.

3. The voltage supply controller according to claim 1, wherein the second transistor includes a dual gate oxide transistor.

4. The voltage supply controller according to claim 1, wherein the high voltage is ranged from 3V to 5V.

5. The voltage supply controller according to claim 1, wherein the first threshold voltage is about 1.2V, and the second threshold voltage is about 0.6V.

6. A voltage supply controller, suitable for use for a low operation voltage device comprising a voltage source receiving terminal, the low operation voltage device outputting an operation enable signal during operation, the voltage supply controller comprising:

a first transistor, comprising a gate and a first source/drain region coupled to a high voltage, the first transistor having a first threshold voltage; and a second transistor, comprising a first source/drain region coupled to the high voltage, a gate to receive the operation enable signal, the second transistor having a second threshold voltage lower than the first threshold voltage;

at least one voltage drop transistor, comprising a first control terminal coupled to a second source/drain region of the first transistor and a second source/drain region of the second transistor, and a second control terminal coupled to the voltage source receiving terminal to provide a voltage drop function; wherein when the low operation voltage device is not operated, the second transistor is cut off, and the voltage drop of the high voltage received at the voltage source receiving terminal is controlled by the first transistor and the voltage drop transistor, and when the low operation voltage device is operated, the operation enable signal conducts the second transistor to control the voltage drop of the high voltage.

7. The voltage supply controller according to claim 6, wherein the voltage drop transistor includes a gate control terminal coupled to the first control terminal.

8. The voltage supply controller according to claim 6, wherein the first transistor includes a dual gate oxide transistor.

9. The voltage supply controller according to claim 6, wherein the second transistor includes a dual gate oxide transistor.

10. The voltage supply controller according to claim 6, wherein the voltage drop transistor includes a dual gate oxide transistor.

11. The voltage supply controller according to claim 6, wherein the high voltage is ranged from 3V to 5V.

* * * * *